US005832904A

United States Patent [19]

Morishita et al.

[11] Patent Number: 5,832,904

[45] Date of Patent: Nov. 10, 1998

[54] FUEL-FEED SYSTEM FOR AN ENGINE

[75] Inventors: Akira Morishita; Keiichi Konishi; Masayasu Miyajima, all of Tokyo, Japan

[73] Assignee: Mitsubishi Denki Kabushiki Kaisha, Tokyo, Japan

[21] Appl. No.: 974,885

[22] Filed: Nov. 20, 1997

[30] Foreign Application Priority Data

May 30, 1997 [JP] Japan ..... 9-142129

[51] Int. Cl.[6] ..... F02M 33/02

[52] U.S. Cl. ..... 123/514; 123/447; 123/198 D

[58] Field of Search ..... 123/514, 447, 123/198 D, 495; 417/283, 423.11, 269, 473; 92/165 R, 166, 167, 168

[56] References Cited

U.S. PATENT DOCUMENTS

| | | | |
|---|---|---|---|
| 2,512,025 | 6/1950 | Lauck | 417/283 |
| 2,665,641 | 1/1954 | Lauck | 417/283 |
| 3,806,283 | 4/1974 | Leueret | 417/283 |
| 4,148,288 | 4/1979 | Steiger | 123/495 |
| 4,597,322 | 7/1986 | Garnjost | 92/167 |
| 5,474,050 | 12/1995 | Cook | 123/198 D |
| 5,476,080 | 12/1995 | Brunnhafer | 123/198 D |
| 5,682,861 | 11/1997 | Stockner | 123/495 |
| 5,709,197 | 1/1998 | Oshidari | 123/198 D |

FOREIGN PATENT DOCUMENTS 7-12029 1/1995 Japan .

*Primary Examiner*—Carl S. Miller

*Attorney, Agent, or Firm*—Sughrue, Mion, Zinn, Macpeak & Seas, PLLC

[57] ABSTRACT

In a high-pressure fuel pump, a bellows chamber communicates with a fuel tank. A volume chamber having a predetermined volume is arranged in a return passage which returns a fuel stayed in the bellows chamber to the fuel tank. The fuel which has stayed in a region in the return passage can be flowed into the volume chamber to be prevented from flowing back to the bellows chamber.

12 Claims, 12 Drawing Sheets

FUEL-FEED SYSTEM FOR AN ENGINE

The present invention relates to improvements in a fuel-feed system for an engine such as an internal combustion engine.

In FIG. 14, there is shown a sectional view of a conventional high-pressure fuel pump. In FIG. 14, reference numeral 1 designates the high-pressure fuel pump which is attachable to e.g. a housing of an engine (not shown). Reference numeral 2 designates a cam which is driven by the engine at a half of the rotation of the engine, and which has six projections formed thereon. Reference numeral 3 designates a cam roller which contacts with the cam. Reference numeral 4 designates a pin which rotatably supports the roller. Reference numeral 5 designates a tappet which rotatably supports the pin, and which is formed in a lidded cylindrical shape.

Reference numeral 6 designates a spring holder which is provided on the tappet. Reference numeral 7 designates a bracket which slidably supports the tappet 5, and which has an inner surface formed with a tappet sliding portion 7*a*. Reference numeral 8 designates a piston which is reciprocatively driven by the cam 2 through the tappet. Reference numeral 9 designates a sleeve which supports the piston under a reciprocating motion, and which provides a pumping chamber as a fuel pressurization chamber. Reference numeral 10 designates a housing which supports the sleeve 9 so as to surround the sleeve. Reference numeral 11 designates metallic bellows which have one end fixed to a holder 8*a* provided on the piston 8 and the other end fixed to the housing 10, and which store a fuel leaked from between the piston 8 and the sleeve 9.

Reference numeral 12 designates a compression coil spring which extends between the spring holder 6 and the housing 10. Reference numeral 13 designates a plate A which is arranged on the sleeve 9, and which has an intake hole, a discharge hole and a return hole formed therein. Reference numeral 14 designates a plate B which is arranged so as to sandwich a reed valve 15 between the plate A 13 and itself, and which has an intake hole, a discharge hole and a return hole formed therein.

The reed valve 15 has a one way valve for intake, a one way valve for discharge and a return hole (not shown) formed therein. Reference numeral 16 designates a spring guide which is attached to the plate B 14. Reference numeral 17 designates a compression coil spring which extends between the spring guide and the piston 8, and which constantly urges the piston 8 toward the tappet 5.

Reference numeral 18 designates a casing which has an intake port 18*a*, a discharge port 18*b* and a return port 18*c* formed therein. Reference numeral 19 designates a filter which is arranged in the intake port 18*a*. Reference numeral 20 designates an intake passage which is formed in the casing 18. Reference numeral 21 designates a piston damper which is arranged in the intake passage. Reference numeral 22 designates a discharge passage which is formed in the casing 18. Reference numerals 23 and 24 designate a buffer vessel and a resonator, respectively, which are arranged in the discharge passage. Between the buffer vessel and the resonator is arranged a communicating passage 25. Reference numeral 26 designates a return passage which returns a fuel stored in the bellows chamber to a fuel tank, and which is formed in the casing 18.

Reference numeral 27 designates a return pipe which communicates with the return passage 26 in the casing 18, and which forms a part of the return passage. Reference numeral 28 designates a return pipe which communicates with the piston damper 21.

In the conventional system thus constructed, the rotation of the cam 2 reciprocates the piston 8 through the cam roller 3, the pin 4 and the tappet 5. When the piston 8 lowers, a fuel flows from the fuel intake port 18*a* into the pumping chamber through the filter 19, the intake passage 20, the piston damper 21, the intake passage 20, the intake hole in the plate A 13, the intake valve in the reed valve 15 and the intake hole in the plate B 14.

When the piston 8 lifts, the intake valve in the reed valve 15 is closed, and the discharge valve in the reed valve opens to discharge the fuel in the pumping chamber through the discharge hole in the plate A 13, the discharge passage 22, the buffer vessel 23, the resonator 24, the discharge passage 22 and the discharge port 18*b*. On the other hand, the fuel which has leaked from between the piston 8 and the sleeve 9 is prevented by the bellows 11 from leaking outside. The fuel leaked into the bellows 11 is returned to the fuel tank through the return hole in the sleeve 9, the return hole in the plate A 13, the return hole in the plate B 14, the return hole in the reed valve 15, the return passage 26 and the return pipe 27.

An intake route, a discharge route and a return route for the fuel in the conventional system will be described in detail with reference to FIG. 15. In FIG. 15, reference numeral 29 designates the fuel tank. Reference numeral 30 designates a low pressure pump which is arranged in the fuel tank for intake of the fuel. Reference numeral 31 designates an intake pipe which is the fuel from the low pressure pump to the intake port 18*a* through a low pressure regulator 32, and which communicates with the intake port 18*a*.

Reference numeral 33 designates a discharge pipe which communicates with the discharge port 18*b*, and which communicates with a high-pressure regulator 60 through a delivery pipe 34. Reference numeral 35 designates a return pipe which returns the fuel from delivery pipe 34.

The fuel which is stored in the bellows chamber defined by the bellows 11 is returned into the fuel tank 29 through the return pipe 27.

In conventional system, a rise in temperature in a fuel system due to a high speed operation of the engine replaces air in the bellows 11 of the high-pressure fuel pump 1 and in the return pipe 27 with gasoline vapor. During idling of the engine, liquefied gasoline is apt to stay in a region in the return pipe 27, which is lower than the bellows 11, and which is indicated by a reference A in FIG. 15.

During standstill of the engine, the gasoline vapor peculiarly in the bellows 11 and in a fuel pipe/fuel passage near to the engine is condensed by a drop in temperature to lower a pressure so as to produce a negative pressure, causing the fuel stayed in the fuel pipe, e.g. in the region A to flow back through the return passage 27 so as to be filled in the bellows 11.

When the engine starts under such circumstances, the volume in the bellows 11 in a fluid-sealing situation is abruptly decreased by pump lift of the piston 8 to produce an impactful variation in pressure due to hole resistance in the return passage and inertia of the fuel. The vibration caused by the variation in pressure is transmitted from the return pipe 27 to a plate for supporting the return pipe 27, making a noise. The variation in pressure in the bellows 11 is also contributory to a decrease in life of the bellows, causing a problem in that reliability of the system is decreased. It is an object of the present invention to solve the problems stated earlier, and to provide a fuel-feed system for an engine capable of preventing an abnormal variation in pressure of a fuel to avoid the occurrence of a noise, and of improving the life of bellows to improve the reliability of the system.

According to a first aspect of the present invention, there is provided a fuel-feed system for an engine comprising a high-pressure fuel pump including a driving member to be rotated by an engine, a piston reciprocatively driven by the driving member, a sleeve for supporting the piston so as to carry out a reciprocating motion, the sleeve providing a pumping chamber, a housing for supporting the sleeve so as to surround the sleeve, and bellows having one end fixed to the piston and the other end fixed to the housing, the bellows providing a bellows chamber for storing a fuel leaked from between the piston and the sleeve; a return passage for communicating the bellows of the pump and a fuel tank to return the fuel stored in the bellows chamber to the fuel tank; and means for restraining a variation in pressure of the fuel due to expansion and contraction of the bellows.

According to a second aspect of the present invention, the means for restraining a variation in pressure of the fuel is a volume chamber which is arranged in the return passage and has a predetermined volume.

According to a third aspect of the present invention, the volume in the volume chamber is set so as to be larger than volume of the fuel which can stay in a portion of the return passage from the volume chamber to the fuel tank.

According to a fourth aspect of the present invention, the means for restraining a variation in pressure of the fuel is a damper which is arranged in at least one of the bellows chamber and the return passage.

According to a fifth aspect of the present invention, the damper is an annular rubber tube which is arranged in a damper chamber.

According to a sixth aspect of the present invention, the damper is an annular foamed rubber member which is arranged in a damper chamber and has bubbles contained therein.

According to a seventh aspect of the present invention, the damper is arranged in a recess formed in the housing which provides the bellows chamber.

According to an eighth aspect of the present invention, the means for restraining a variation in pressure of the fuel is a check valve which is arranged in the return passage and prevents the fuel from flowing back to the bellows chamber from a side of the fuel tank.

According to a ninth aspect of the present invention, the check valve is arranged in a reed valve which provides an intake valve and a discharge valve of the pumping chamber of the high-pressure fuel pump.

According to a tenth aspect of the present invention, the means for restraining a variation in pressure of the fuel is a combination of a volume chamber which is arranged in the return passage and has a predetermined volume, and a damper which is arranged in at least one of the bellows chamber and the return passage.

According to an eleventh aspect of the present invention, the means for restraining a variation in pressure of the fuel is a combination of a volume chamber which is arranged in the return passage and has a predetermined volume, and a check valve which is arranged in the return passage and prevents the fuel from flowing back to the bellows chamber from a side of the fuel tank.

According to a twelfth aspect of the present invention, the means for restraining a variation in pressure of the fuel is a combination of a damper which is arranged in at least one of the bellows chamber and the return passage, and a check valve which is arranged in the return passage and prevents the fuel from flowing back to the bellows chamber from a side of the fuel tank.

In accordance with the fuel-feed system according to the first aspect of the present invention, an impactful variation in pressure can be restrained to prevent a noise from occurring and the life of the bellows from decreasing.

In accordance with the fuel-feed system according to the second aspect of the present invention, an impactful variation in pressure can be restrained by a simple structure to prevent a noise from occurring and the life of the bellows from decreasing.

In accordance with the fuel-feed system according to the third aspect of the present invention, all the fuel which has stayed in a portion of the return passage from the volume chamber to the fuel tank can be flowed into the volume chamber to be prevented from flowing back to the bellows chamber. A variation in pressure in the bellows chamber can be damped so as to be minimized.

In accordance with the fuel-feed system according to the fourth aspect of the present invention, a variation in pressure of the fuel can be damped with good response.

In accordance with the fuel-feed system according to the fifth aspect of the present invention, it is possible to provide the damper with a simple structure and easy attachment.

In accordance with the fuel-feed system according to the sixth aspect of the present invention, an effective damping function for a variation in pressure of the fuel can be provided by a simple structure.

In accordance with the fuel-feed system according to the seventh aspect of the present invention, the housing can be utilized as a member for attaching the damper, decreasing the number of required parts and making the system smaller.

In accordance with the fuel-feed system according to the eighth aspect of the present invention, the bellows chamber can be effectively prevented from being filled with the fuel to restrain a variation in pressure, preventing a noise from occurring and the life of the bellows from decreasing.

In accordance with the fuel-feed system according to the ninth aspect of the present invention, the fuel can be prevented from flowing from the return passage back to the bellows chamber to damp a variation in pressure of the fuel easily.

In accordance with the fuel-feed system according to the tenth aspect of the present invention, a variation in pressure of the fuel can be damped with good response and in an effective manner.

In accordance with the fuel-feed system according to the eleventh aspect of the present invention, the entry of the fuel into the bellows chamber can be minimized to prevent a variation in pressure in the bellows chamber from occurring in an effective manner.

In accordance with the fuel-feed system according to the twelfth aspect of the present invention, it is possible to damp a variation in pressure of the fuel with good response and in an effective manner by an extremely simple structure.

IN THE DRAWINGS

Figure 14:
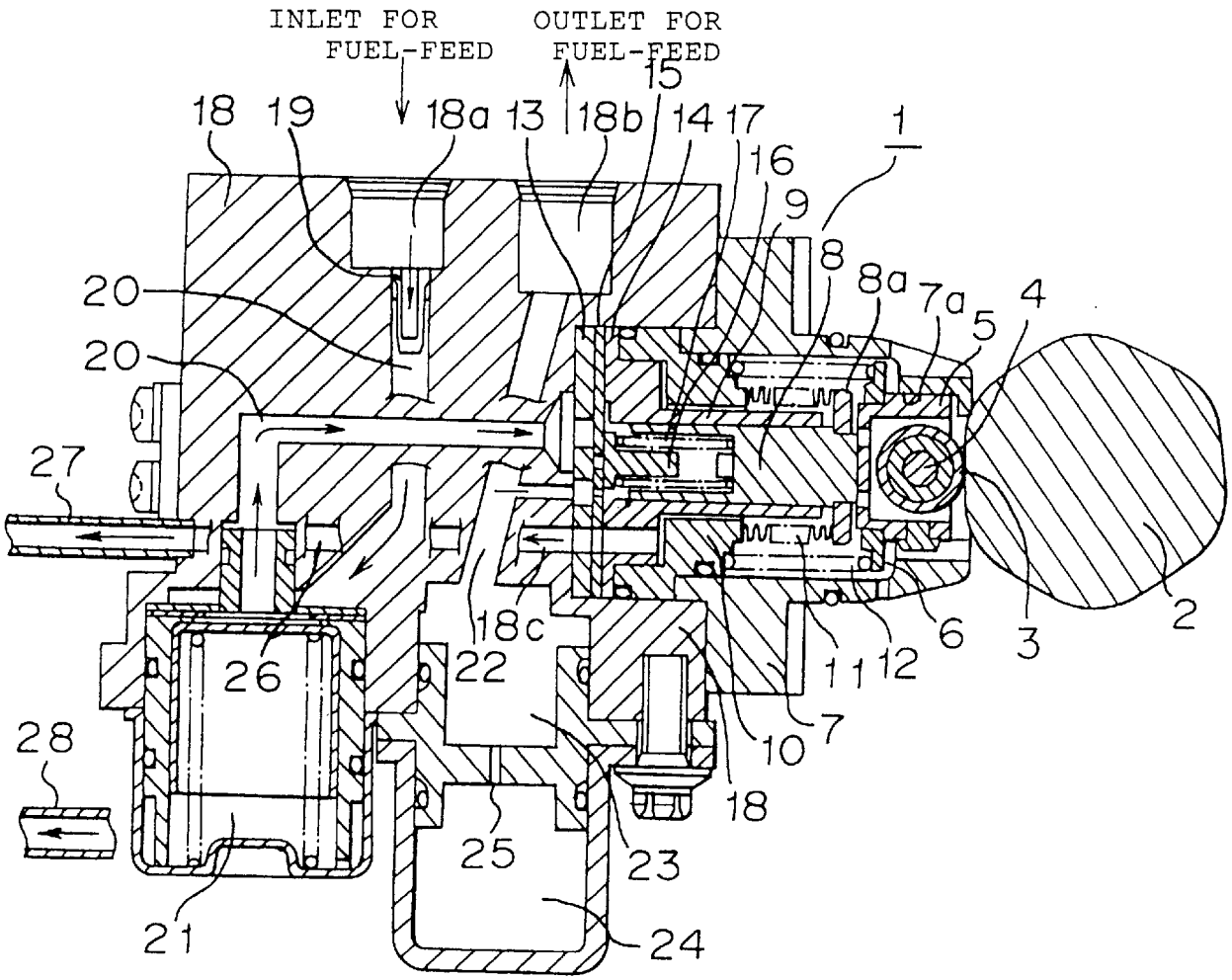
FIG. 14 is a sectional view showing a high-pressure fuel pump in a conventional system.
Figure 15:
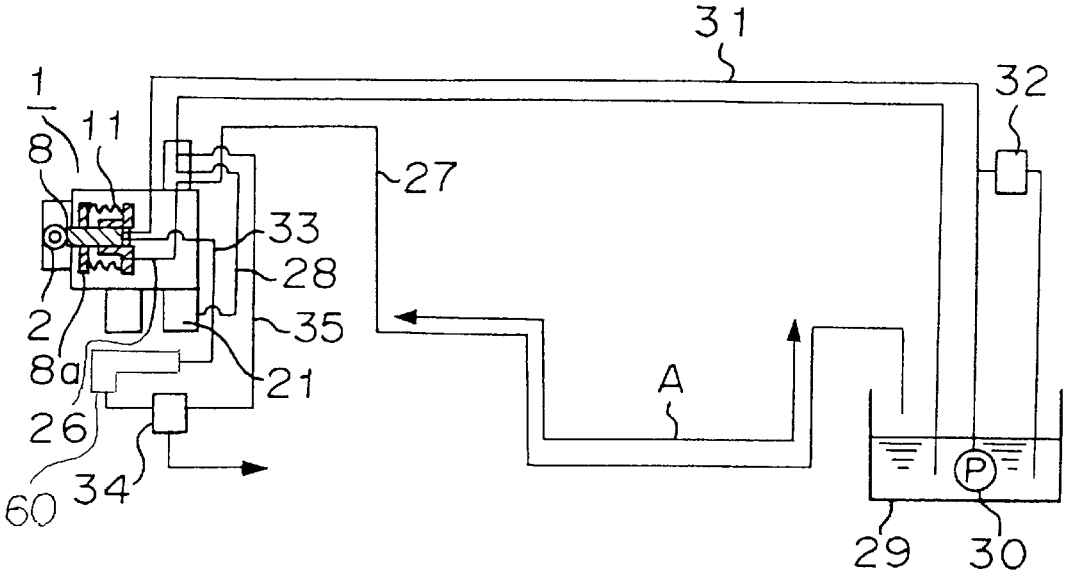
FIG. 15 is a schematic view showing the conventional system.

In the description of preferred embodiments, parts identical or corresponding to the parts of the conventional system shown in FIGS. 14 and 15 will be indicated by the same reference numerals as those of the conventional system, and explanation of these parts will be omitted.

EMBODIMENT 1

Figure 1:
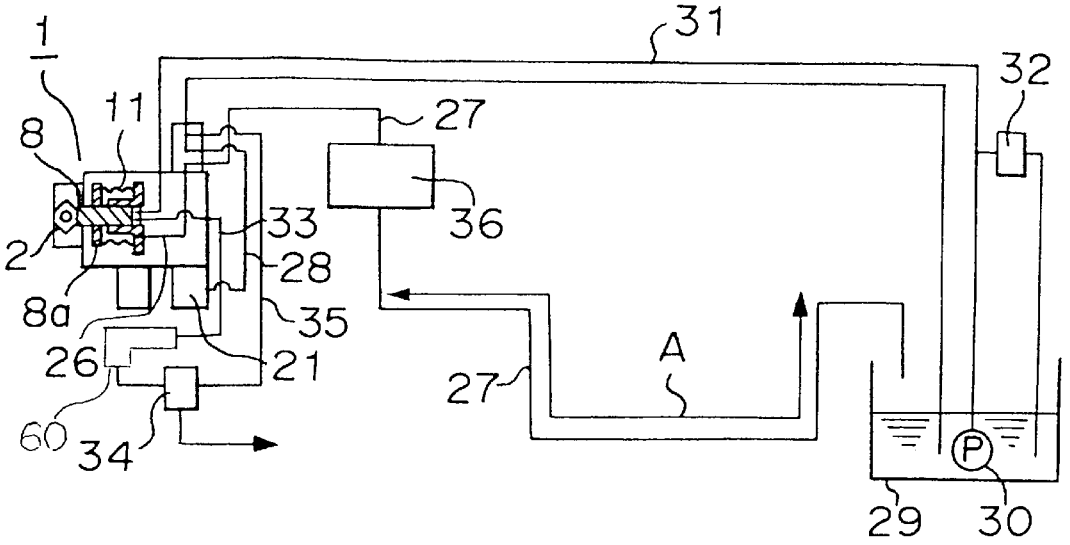
FIG. 1 is a schematic view showing a first embodiment of the present invention.

In FIG. 1, there is shown a schematic view of a fuel-feed system for an engine according to the present invention. In FIG. 1, reference numeral 36 designates a volume chamber which is arranged in the returned pipe 27. The volume in the volume chamber is set so as to be larger than the maximum volume of a fuel which can stay in a portion of the return passage 27 from the volume chamber 36 to the fuel tank 29.

In the first embodiment of the present invention thus constructed, a rise in temperature in a fuel system due to a high speed operation of the engine replaces the air in the bellows 11 of the high-pressure fuel pump 1 and in the return pipe 27 with gasoline vapor.

During idling of the engine, liquefied gasoline stays in the region A in the return pipe 27, which is lower than the bellows 11.

In addition, during of standstill of the engine, the gasoline vapor peculiarly in the bellows 11, the fuel pipe near to the engine and the fuel passage is condensed by a drop in temperature to lower its pressure so as to produce a negative pressure in the bellows 11 and in portions near thereto, providing such a function that the fuel which has stayed in the region A in the return pipe 27 is flowed back into the bellows 11.

The fuel which has stayed in the region A in the return pipe 27 flows back into the volume chamber 36 through the return pipe 27. Since the volume in the volume chamber 36 is set so as to be larger than the total volume in the return pipe 27 from the outlet of the volume chamber 36 from the fuel tank 29, the volume chamber 36 is ensured to contain air without being filled with the fuel even if all the fuel which has stayed in the region A flows into the volume chamber 36. There is no danger of the fuel in the region A flowing into the bellows 11 through the volume chamber 36, preventing the bellows 11 from being filled with the liquefied gasoline.

Even if the engine starts under such circumstances, and even if the volume in the bellows 11 is decreased by pump lift of the piston 8, a variation in pressure can be minimized to prevent a noise from occurring and the life of the bellows 11 from decreasing because the bellows 11 is not filled with the fuel. It is effective to locate the volume chamber 36 at a lower portion than the high-pressure fuel pump 1 because the fuel becomes hardly susceptible to flow back to the high-pressure fuel pump 1.

EMBODIMENT 2

Figure 2:
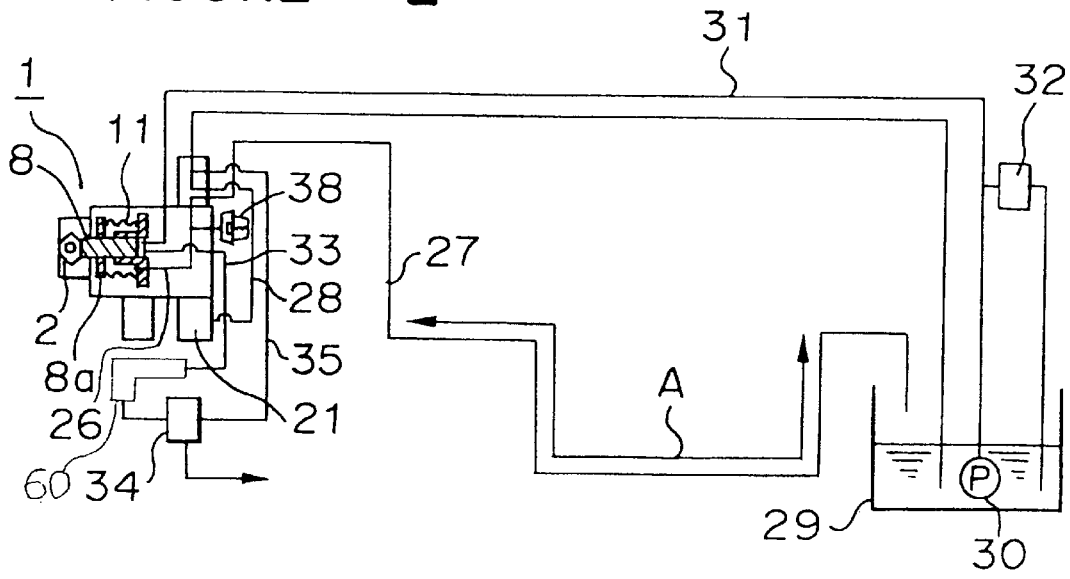
FIG. 2 is a schematic view showing a second embodiment of the present invention.
Figure 3:
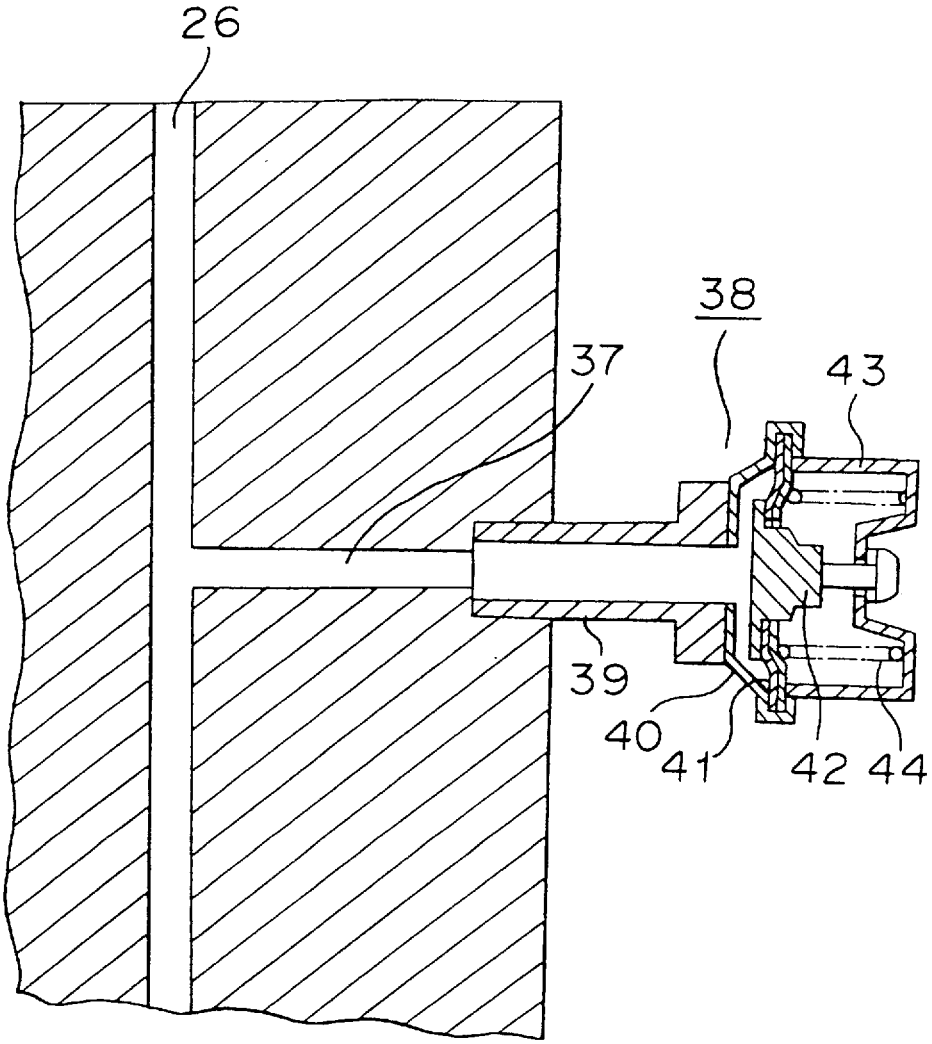
FIG. 3 is an enlarged sectional view showing essential parts according to the second embodiment of the present invention.

In FIG. 2, there is shown a schematic view of a second embodiment of the present invention. In FIG. 3, there is shown an enlarged sectional view of essential parts according to the second embodiment of the present invention. In FIGS. 2 and 3, reference numeral 37 designates a damper passage which is provided so as to communicate with the return passage 26 in the casing 18. Reference numeral 38 designates a damper which is attached to the damper passage. Reference numeral 39 designates a fixing portion which is attached to the casing 18. Reference numeral 40 designates a casing which is attached to the fixing portion. Reference numeral 41 designates a diaphragm which has an outer periphery fixed to the casing. Reference numeral 42 designates a valve which is fixed to an inner periphery of the diaphragm. Reference numeral 43 designates a bracket which is fixed to the casing 40. Reference numeral 44 designates a compression coil spring which extends between the bracket 43 and the diaphragm 41, and which urges the diaphragm 41 toward the left direction in FIG. 3.

In the second embodiment thus constructed, when the engine starts in such a situation that the bellows 11 are filled with the fuel, the volume in the bellows 11 is abruptly decreased by pump lift of the piston 8 to introduce a chance to produce a variation in pressure due to hole resistance in the return passage 26 and inertia of the fuel. Such a variation in pressure can be damped by the spring 44 and the diaphragm 41 of the damper 38 to avoid an impactful variation in pressure. The occurrence of a noise through the return pipe 27 and a decrease in the life of the bellows 11 are avoidable.

EMBODIMENT 3

Figure 4:
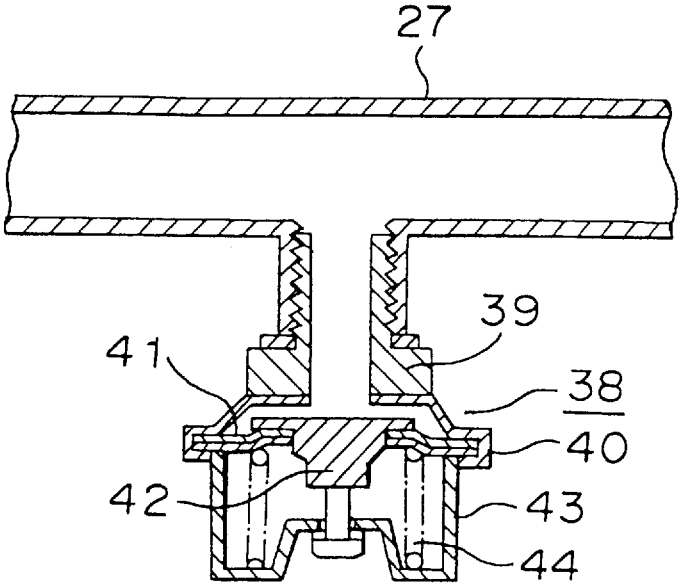
FIG. 4 is an enlarged sectional view showing essential parts according to the a third embodiment of the present invention.

Although in the second embodiment, the damper 38 is attached to the return passage 26 in the casing 18, the damper 38 may be attached to the return pipe 27 as shown in FIG. 4, offering functions and effects similar to the second embodiment.

EMBODIMENT 4

Although in the second and third embodiments, the damper 38 is attached to the return passage 26 or the return pipe 27, the damper 38 can be attached so as to connect directly with the bellows chamber defined by the bellows 11 to damp an impactful variation in pressure in a more effective manner.

Figure 5:
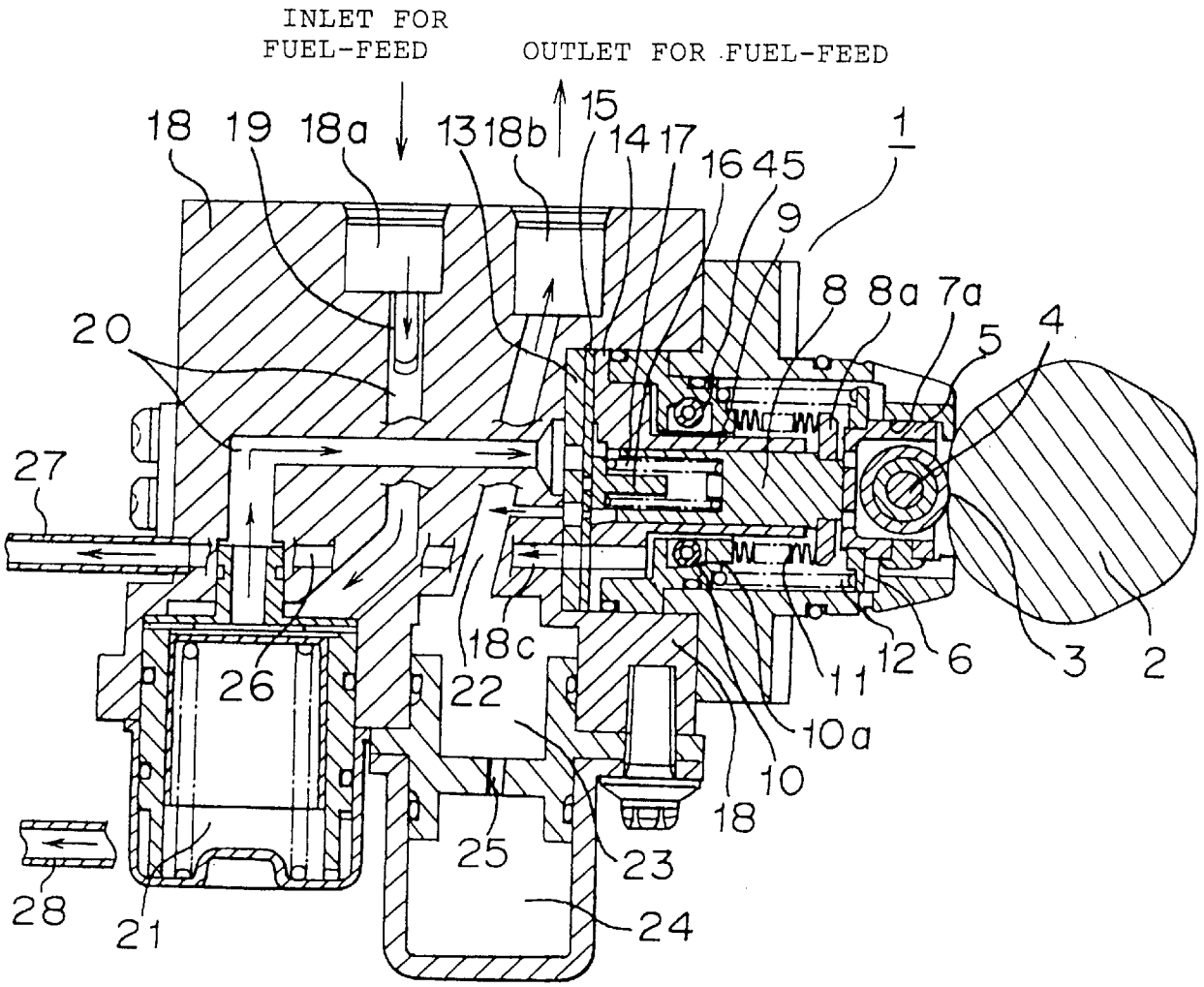
FIG. 5 is an enlarged sectional view showing essential parts according to a fourth embodiment of the present invention.

This mode is a fourth embodiment, which will be explained with reference to FIG. 5. In FIG. 5, reference numeral 10*a* designates an annular recess which is arranged in the housing 10 to provide a damper chamber, and which forms the bellows chamber together with the bellows 11. Reference numeral 45 designates an annular rubber tube which is arranged in the recess, and which forms the damper. By such arrangement, the rubber tube 45 can damp a variation in pressure of the fuel to avoid an impactful variation in pressure.

EMBODIMENT 5

Although in the fourth embodiment, the rubber tube 45 is used as the damper, an annular foamed rubber member with air bubbles included therein can be substituted, offering similar functions and effects.

EMBODIMENT 6

Figure 6:
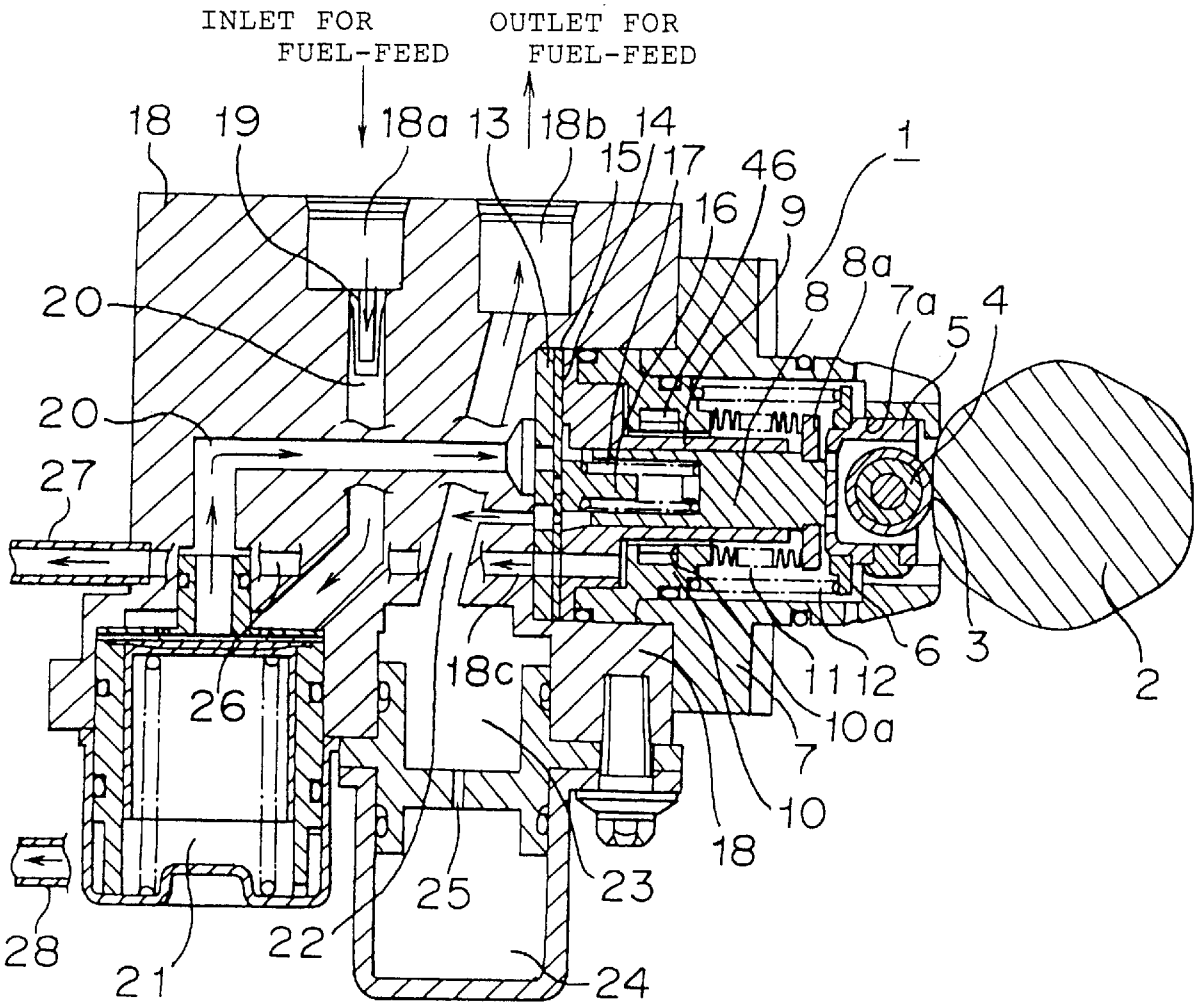
FIG. 6 is a schematic view showing a sixth embodiment of the present invention.

Although in the fourth embodiment, the rubber tube 45 is arranged in the recess 10*a* of the housing 10 forming the bellows chamber, a diaphragm 46 as a flexible member may be arranged in the recess 10*a* of the housing 10 as shown in FIG. 6 to damp a variation in pressure in the bellows chamber by the diaphragm 46 forming the damper.

The damper 38, the rubber tube 45 and the diaphragm 46 may be provided in both of the bellows chamber and the return passage 26 or both of the bellows chamber and the return pipe 27.

EMBODIMENT 7

Figure 7:
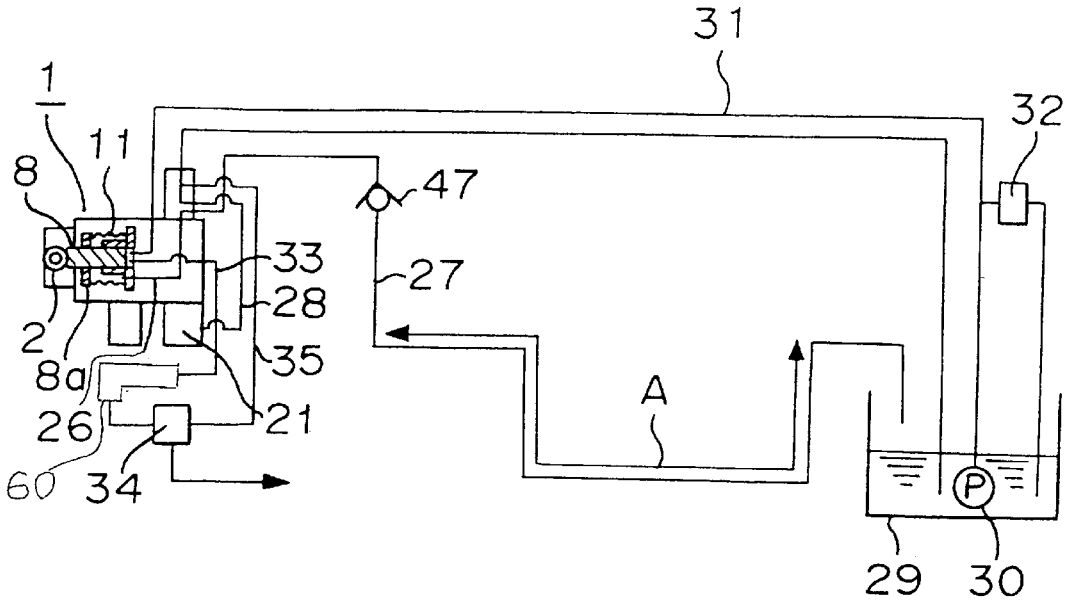
FIG. 7 is a schematic view showing a seventh embodiment of the present invention.

In a seventh embodiment shown in FIG. 7, a check valve 47 is arranged in the return pipe 27. The check valve 47 permits the fuel to flow from the bellows chamber to the fuel tank 29 though the check value prevents the fuel from flowing from the fuel tank 29 back to the bellows chamber.

Even if the fuel which has stayed in the region A in the return pipe 27 is going to flow back to the bellows chamber by the presence of a negative pressure in the bellows chamber, the check valve 47 can prevent the fuel from entering the bellows chamber to be free from such a situation that the bellows chamber is filled with the fuel, avoiding an impactful variation in pressure.

Even if the fuel leaks from the check valve 47 to the bellows chamber, a great negative pressure is generated by the check valve 47 to produce bubbles in the liquid during the expansion and contraction motion of the bellows 11 at a low rotation of the engine just after start. When the rotation of the engine reaches such a level that an impactful pressure can be generated in the bellows chamber, the bellows chamber has gotten rid of being filled with the fuel, preventing a noise from occurring or the bellows 11 from being damaged.

EMBODIMENT 8

Figure 8:
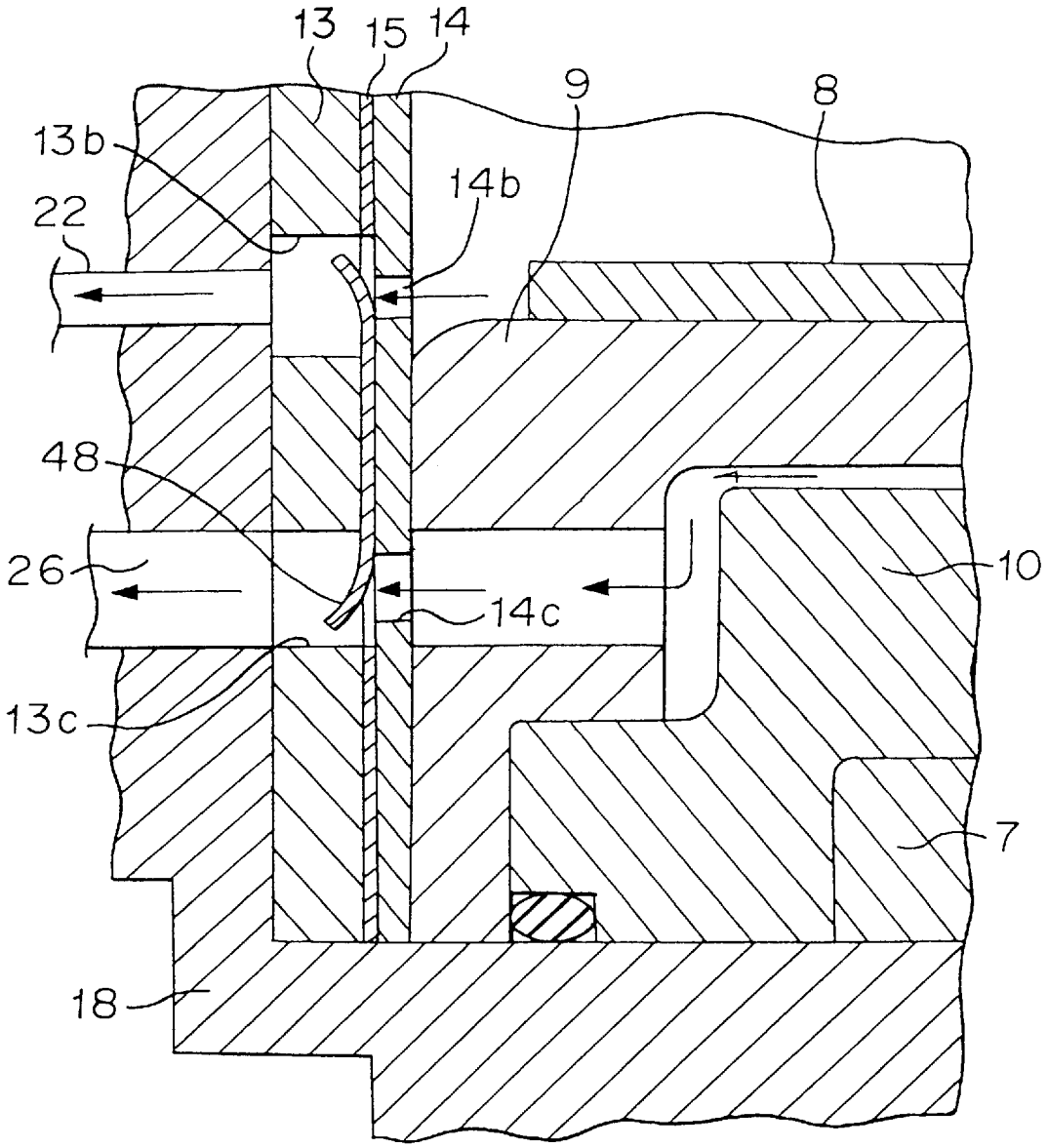
FIG. 8 is an enlarged sectional view showing essential parts according to an eighth embodiment of the present invention.

In an eighth embodiment shown in FIG. 8, a check valve 48 is provided on a reed valve 15 which forms the intake valve and the discharge valve for the pumping chamber of the high-pressure fuel pump. The check valve 48 is made of a flat spring, which permits the fuel to flow from the bellows chamber toward the fuel tank 29 and prevents the fuel from flowing back toward the bellows chamber from the fuel tank 29. When the piston 8 lowers, a negative pressure is produced in the pumping chamber to close the check valve 48. As a result, the fuel is prevented from flowing back to the pumping chamber through the return pipe 27 and the return passage 26, and air is sealed in the form of bubbles in the remaining fuel in the bellows chamber. Although the expansion and contraction motion of the bellows 11 introduces a chance to abruptly pressurize the fuel in the bellows chamber when the piston 8 lifts, the presence of the bubbles can damper the pressure of the fuel to avoid an abrupt variation in pressure.

In FIG. 8, reference numeral 13*b* designates the return hole formed in the plate A 13, reference numeral 14*b* designates the discharge hole formed in the plate B 14, and reference numeral 14*c* designates the return hole formed in the plate B 14.

EMBODIMENT 9

Figure 9:
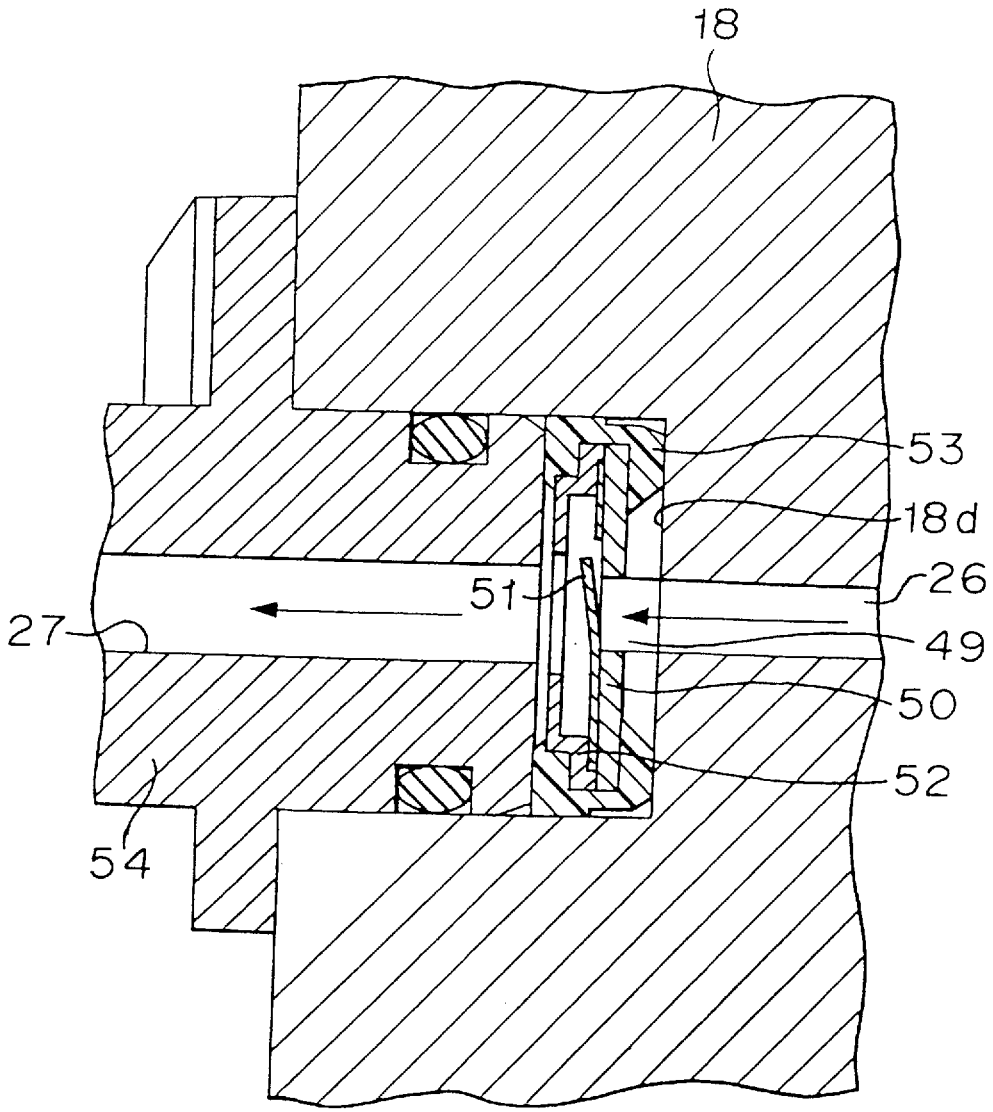
FIG. 9 is an enlarged sectional view showing essential parts according to a ninth embodiment of the present invention.

Although in the eighth embodiment, the check valve 48 is provided on the reed valve 15 attached to the pumping chamber, a check valve 49 may be provided at an opening end of the return passage 26 in the casing 18 as shown in FIG. 9 to offer a similar function.

In FIG. 9, reference numeral 18*d* designates a receptive recess which is formed at the opening end of the casing 18. Reference numeral 49 designates the check valve which is arranged in the receptive recess. Reference numeral 50 designates a valve seat. Reference numeral 51 designates a flat spring which is provided on the valve seat to form a one way valve. Reference numeral 52 designates a plate which guides the flat spring. Reference numeral 53 designates a rubber member which has the valve seat 50, the flat spring 51 and the plate 52 integrally formed thereon. Reference numeral 54 designates a nipple which locks the check valve 49 in the recess 18*d*, and which is fixed to the casing 18.

The ninth embodiment can offer an advantage in that attachment and removal of the check valve 49 become easier.

EMBODIMENT 10

Figure 10:
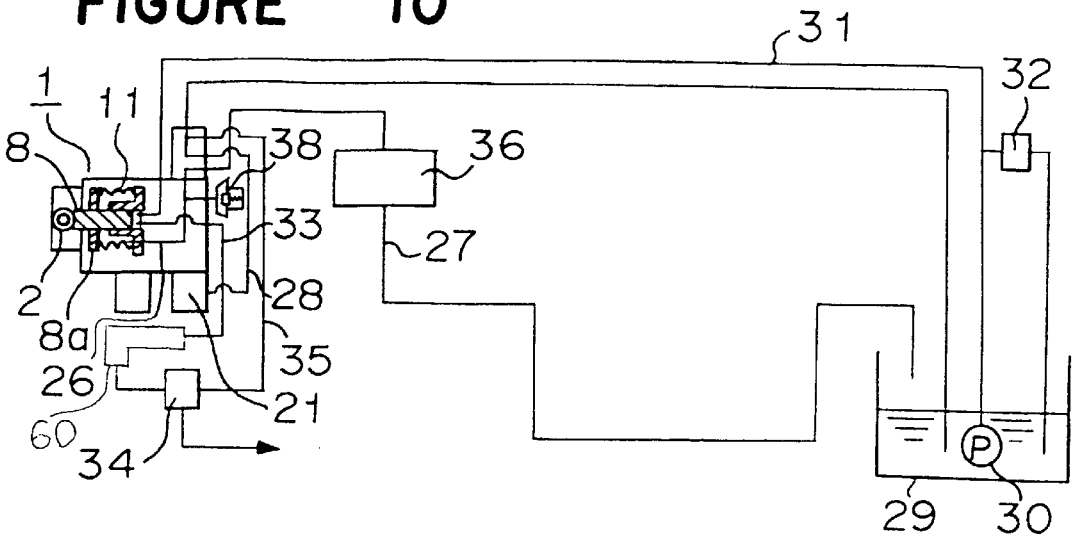
FIG. 10 is a schematic view showing a tenth embodiment of the present invention.

In a tenth embodiment shown in FIG. 10, not only the volume chamber 36 is arranged in the return pipe 27 but also the damper 38 is arranged in the return passage 26, offering an advantage in that a variation in pressure of the fuel can be damped in an effective way with good response.

EMBODIMENT 11

Figure 11:
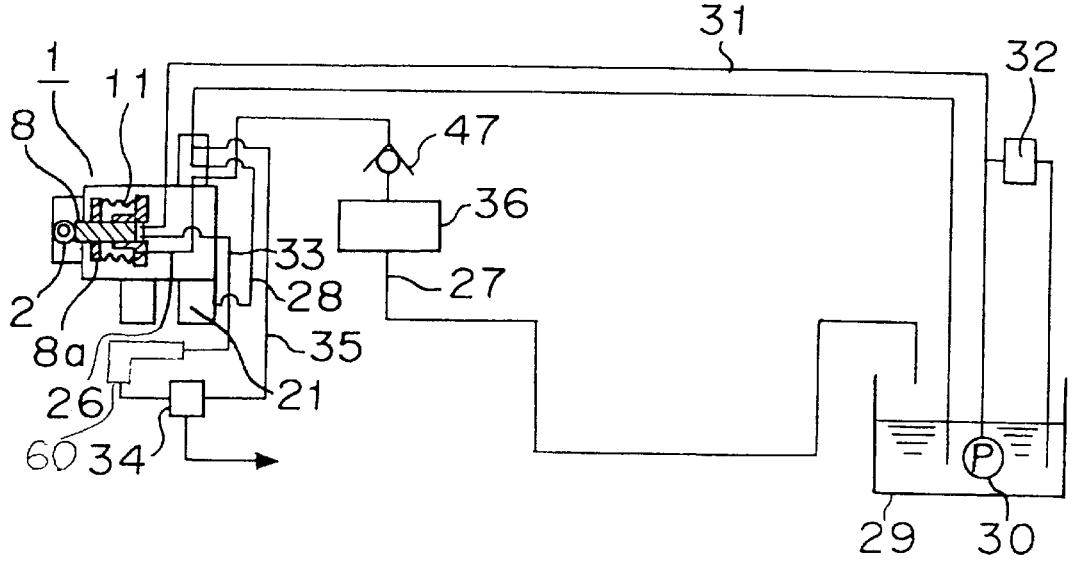
FIG. 11 is a schematic view showing an eleventh embodiment of the present invention.

In an eleventh embodiment shown in FIG. 11, not only the check valve 47 is arranged in the return pipe 27 at a side of the bellows chamber but also the volume chamber 36 is arranged in the return pipe 27 at a side of the fuel tank 29, minimizing the entry of the fuel into the bellows chamber.

EMBODIMENT 12

Figure 12:
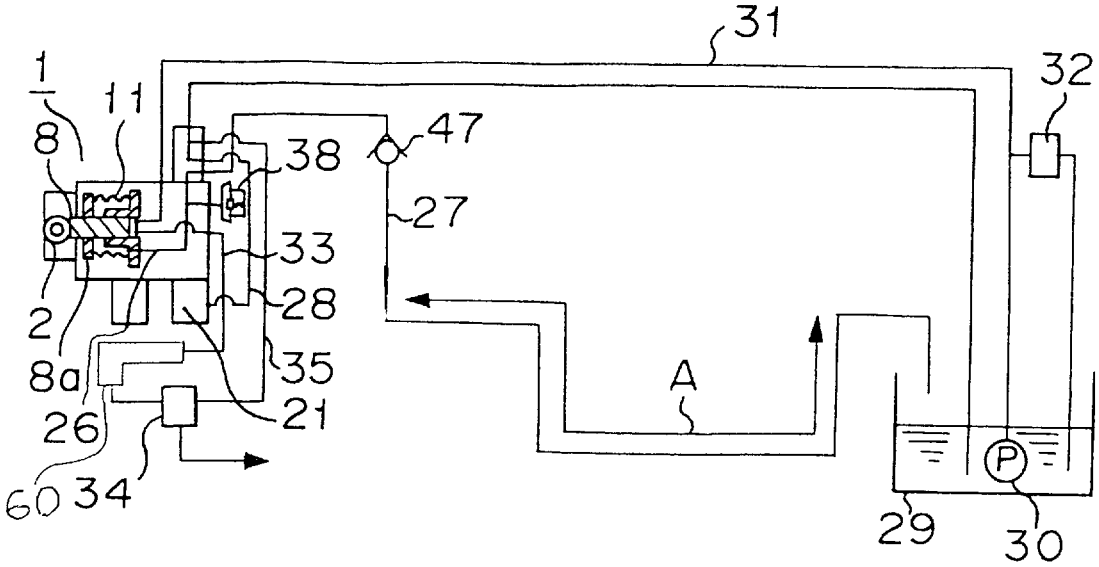
FIG. 12 is a schematic view showing a twelfth embodiment of the present invention.

In a twelfth embodiment shown in FIG. 12, not only the damper 38 is arranged in the return passage 26 but also the check valve 47 is arranged in the return pipe 27. The fuel which has stayed in the region A in the return pipe 27 can be prevented by the check valve 47 from entering the bellows chamber, and a variation in pressure of the fuel which has extremely reduced in the bellows chamber can be damped by the damper 38.

EMBODIMENT 13

Figure 13:
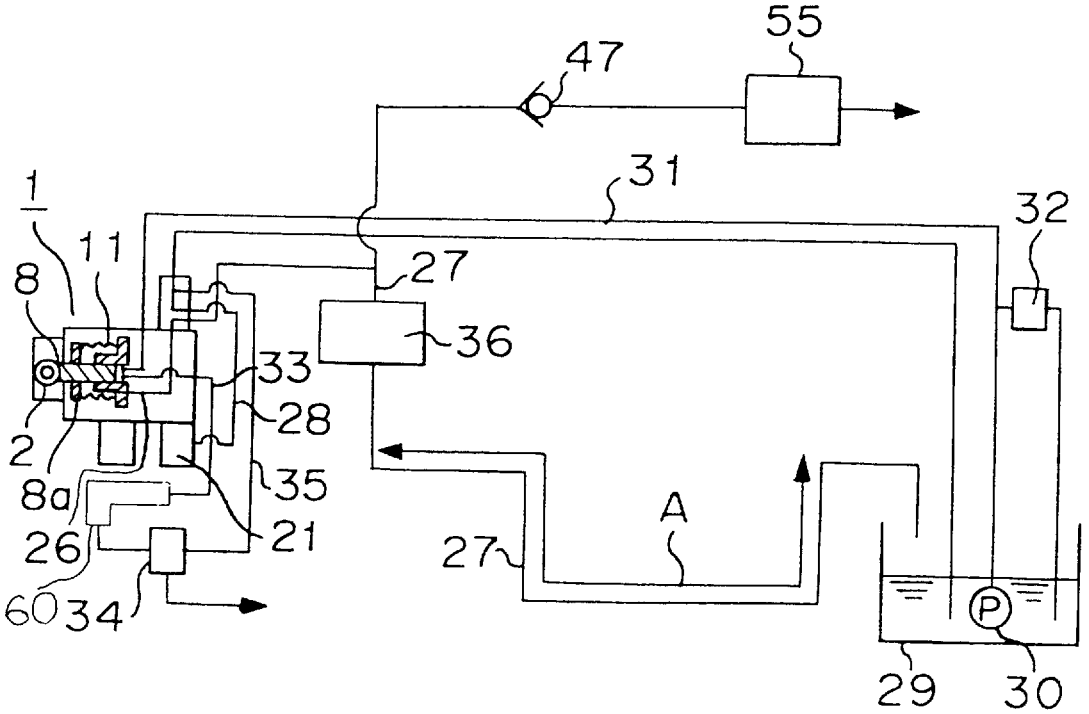
FIG. 13 is a schematic view showing a thirteenth embodiment of the present invention.

In a thirteenth embodiment shown in FIG. 13, not only the volume chamber 36 is arranged in the return pipe 27 but also the check valve 47 is arranged between the return pipe 27 and a canister 55. The fuel which has stayed in the region A in the return pipe 27 can be prevented by the volume chamber 36 from entering the bellows chamber. And the check valve 47 can introduce air into the bellows chamber through the canister 49 to avoid such a situation that the bellows chamber is filled with the fuel.

As a modification of the thirteenth embodiment, the volume chamber 36 may be omitted with the check valve 47 left.

As another modification, a combination of the volume chamber 36, the check valves 47, 48 and 49, and the dampers 38, 45 and 46 can damp a variation in pressure in a more effective way.

What is claimed is:

1. A fuel-feed system for an engine comprising:

a high-pressure fuel pump including a driving member to be rotated by an engine, a piston reciprocatively driven by the driving member, a sleeve for supporting the piston so as to carry out a reciprocating motion, the sleeve providing a pumping chamber, a housing for supporting the sleeve so as to surround the sleeve, and bellows having one end fixed to the piston and the other end fixed to housing, the bellows providing a bellows chamber for storing a fuel leaked from between the piston and the sleeve;

a return passage for communicating the bellows of the pump and a fuel tank to return the fuel stored in the bellows chamber to the fuel tank; and means for restraining a variation in pressure of the fuel due to expansion and contraction of the bellows.

2. A fuel-feed system for an engine according to claim 1, wherein the means for restraining a variation in pressure of the fuel is a volume chamber which is arranged in the return passage and has a predetermined volume.

3. A fuel-feed system for an engine according to claim 2, wherein the volume in the volume chamber is set so as to be larger than volume of the fuel which can stay in a portion of the return passage from the volume chamber to the fuel tank.

4. A fuel-feed system for an engine according to claim 1, wherein the means for restraining a variation in pressure of the fuel is a damper which is arranged in at least one of the bellows chamber and the return passage.

5. A fuel-feed system for an engine according to claim 4, wherein the damper is an annular rubber tube which is arranged in a damper chamber.

6. A fuel-feed system for an engine according to claim 4, wherein the damper is an annular foamed rubber member which is arranged in a damper chamber and has bubbles contained therein.

7. A fuel-feed system for an engine according to claim 4, wherein the damper is arranged in a recess formed in the housing which provides the bellows chamber.

8. A fuel-feed system for an engine according to claim 1, wherein the means for restraining a variation in pressure of the fuel is a check valve which is arranged in the return passage and prevents the fuel from flowing back to the bellows chamber from a side of the fuel tank.

9. A fuel-feed system for an engine according to claim 8, wherein the check valve is arranged in a reed valve which provides an intake valve and a discharge valve of the pumping chamber of the high-pressure fuel pump.

10. A fuel-feed system for an engine according to claim 1, wherein the means for restraining a variation in pressure of the fuel is a combination of a volume chamber which is arranged in the return passage and has a predetermined volume, and a damper which is arranged in at least one of the bellows chamber and the return passage.

11. A fuel-feed system for an engine according to claim 1, wherein the means for restraining a variation in pressure of the fuel is a combination of a volume chamber which is arranged in the return passage and has a predetermined volume, and a check valve which is arranged in the return passage and prevents the fuel from flowing back to the bellows chamber from a side of the fuel tank.

12. A fuel-feed system for an engine according to claim 1, wherein the means for restraining a variation in pressure of the fuel is a combination of a damper which is arranged in at least one of the bellows chamber and the return passage, and a check valve which is arranged in the return passage and prevents the fuel from flowing back to the bellows chamber from a side of the fuel tank.

* * * * *